US009380826B2

(12) United States Patent
Viniero et al.

(10) Patent No.: US 9,380,826 B2
(45) Date of Patent: Jul. 5, 2016

(54) SKI BOOT WITH IMPROVED MECHANISM TO PASS FROM A SKIING CONFIGURATION TO A WALKING CONFIGURATION

(71) Applicant: SCOTT SPORTS S.A., Givisiez (CH)

(72) Inventors: Nicola Viniero, Volpago del Montello (IT); Achille Morlin, Volpago del Montello (IT); Denis Michelin, Volpago del Montello (IT)

(73) Assignee: Scott Sports S.A., Givisiez (CH)

( * ) Notice: Subject to any disclaimer, the term of this patent is extended or adjusted under 35 U.S.C. 154(b) by 258 days.

(21) Appl. No.: 13/655,682

(22) Filed: Oct. 19, 2012

(65) Prior Publication Data

US 2013/0097892 A1 Apr. 25, 2013

(30) Foreign Application Priority Data

Oct. 20, 2011 (IT) ..... PD2011A0331

(51) Int. Cl.
*A43B 5/04* (2006.01)
*A43B 5/16* (2006.01)

(52) U.S. Cl.
CPC ..... *A43B 5/047* (2013.01); *A43B 5/0466* (2013.01); *A43B 5/0468* (2013.01); *A43B 5/0474* (2013.01); *A43B 5/0452* (2013.01)

(58) Field of Classification Search
CPC .. A43B 5/0452; A43B 5/0466; A43B 5/0468; A43B 5/047; A43B 5/0474
USPC ..... 36/114, 117.7, 117.8, 117.9, 117.4, 36/118.1, 118.7
See application file for complete search history.

(56) References Cited

U.S. PATENT DOCUMENTS

| | | | | | |
|---|---|---|---|---|---|
| 4,519,150 | A * | 5/1985 | Arieh et al. | ..... | 36/118.7 |
| 4,575,958 | A * | 3/1986 | Arieh et al. | ..... | 36/118.4 |
| 4,761,899 | A * | 8/1988 | Marxer | ..... | 36/118.7 |
| 5,265,352 | A * | 11/1993 | Chemello | ..... | 36/118.7 |
| 5,283,964 | A * | 2/1994 | Chemello | ..... | 36/118.7 |
| 5,560,128 | A * | 10/1996 | Marega | ..... | A43B 5/0474 36/118.2 |
| 6,131,313 | A * | 10/2000 | Pierce et al. | ..... | 36/118.3 |
| 6,643,955 | B2 * | 11/2003 | Pierce et al. | ..... | 36/118.3 |
| 2005/0016027 | A1 * | 1/2005 | Trinkaus et al. | ..... | 36/115 |
| 2009/0178304 | A1 * | 7/2009 | Bollard et al. | ..... | 36/118.2 |

FOREIGN PATENT DOCUMENTS

| | | | |
|---|---|---|---|
| EP | 0 664 969 | A2 | 8/1995 |
| EP | 0 740 909 | A1 | 11/1996 |
| EP | 2 082 657 | A1 | 7/2009 |
| FR | 2 857 831 | A1 | 1/2005 |

* cited by examiner

*Primary Examiner* — Khoa Huynh
*Assistant Examiner* — Katharine Gracz
(74) *Attorney, Agent, or Firm* — Blank Rome LLP

(57) ABSTRACT

A ski boot with a leg portion hinged to the foot portion so that the leg portion is able to rotate around a rotation axis (X-X) in relation to the foot portion. The ski boot includes a constraint mechanism for selectively blocking and/or unblocking the rotation of the leg portion in relation to the foot portion depending on whether or not the user wishes to pass from a skiing configuration to a walking configuration. The constraint mechanism comprises a rod having a fixed end hinged to the foot portion and a movable end which interfaces with the leg portion, a support attached to the leg portion and a guide connected to the support for guiding the movable end of the rod. The guide is movable in relation to the support and moves with rotation of the rod during movement of the leg portion in relation to the foot portion.

12 Claims, 6 Drawing Sheets

Fig. 1 - PRIOR ART

Fig. 2 - PRIOR ART

SKI BOOT WITH IMPROVED MECHANISM TO PASS FROM A SKIING CONFIGURATION TO A WALKING CONFIGURATION

OBJECT OF THE INVENTION

The present invention relates to a ski boot, with an improved mechanism for passing from a skiing configuration to a walking configuration.

BACKGROUND OF THE INVENTION

Off-track ski boots differ from ski boots by the fact that they must alternatively permit the skier both to ski and to walk as easily as possible.

To permit the two configurations, respectively walking and skiing, they envisage that the leg portion of the boot, that is the upper part which embraces the lower end of the skier's leg, can rotate in relation to the foot portion, that is, the lower part of the boot which embraces the foot. In particular, the rotation of the leg portion in relation to the foot portion, moves along with and facilitates walking. Such relative rotation may be blocked, by making the leg portion integral with the foot portion, to permit skiing.

The passage from one configuration to the other needs to be as fast and easy a possible given that when practising off-track skiing the skier needs to change the configuration of the boot very frequently depending on the section of path to be tackled each time.

The solutions of the prior art envisage hinging of the leg portion to the foot portion, and guiding of the rotation movement by at least one rod.

At a first fixed end the rod is hinged to the foot portion while at a second, free end, it slides inside a guide attached to the leg portion.

In the walking position, the free end of the rod may slide inside the guide attached to the leg portion while, in the skiing position, the free end of the rod is made integral with the guide and thereby with the leg portion.

Such closure or blockage of the rod may take place by operating a peg which engages in a hole on the rod specially made for it.

As of today the solutions of the prior art have been unable to assure the skier an easy walk.

In fact, while on the one hand the blocking mechanism of the prior art is efficient for the skiing position, on the other the waking configuration is not very easy. In other words, the rod tends to stick inside the guide de facto making walking particularly tiring. The problem is further accentuated by the low operating temperatures and the snow/ice which, during use, tend to further penetrate between the rod and the relative guide, making the sliding thereof increasingly difficult.

Moreover, the type of guide of the leg portion used by the prior solutions poses strong limitations on the reciprocal positions of the connection hinges of the leg portion to the foot portion and the anchorages of the guide rod. These geometric limitations only partially limit the problem of sticking of the leg portion but, on the other hand, create enormous limitations to the overall appearance and functionality of the boot.

SUMMARY OF THE INVENTION

The purpose of the present invention is to make a ski boot which overcomes the drawbacks mentioned with reference to the prior art.

Such drawbacks and limitations are resolved by a ski boot according to claim 1.

Other embodiments of the ski boot according to the invention are described in the subsequent claims.

BRIEF DESCRIPTION OF THE DRAWINGS

Further characteristics and advantages of the present invention will be more clearly comprehensible from the description given below of its preferred and non-limiting embodiments, wherein.

DETAILED DESCRIPTION OF THE INVENTION

Figure 1:
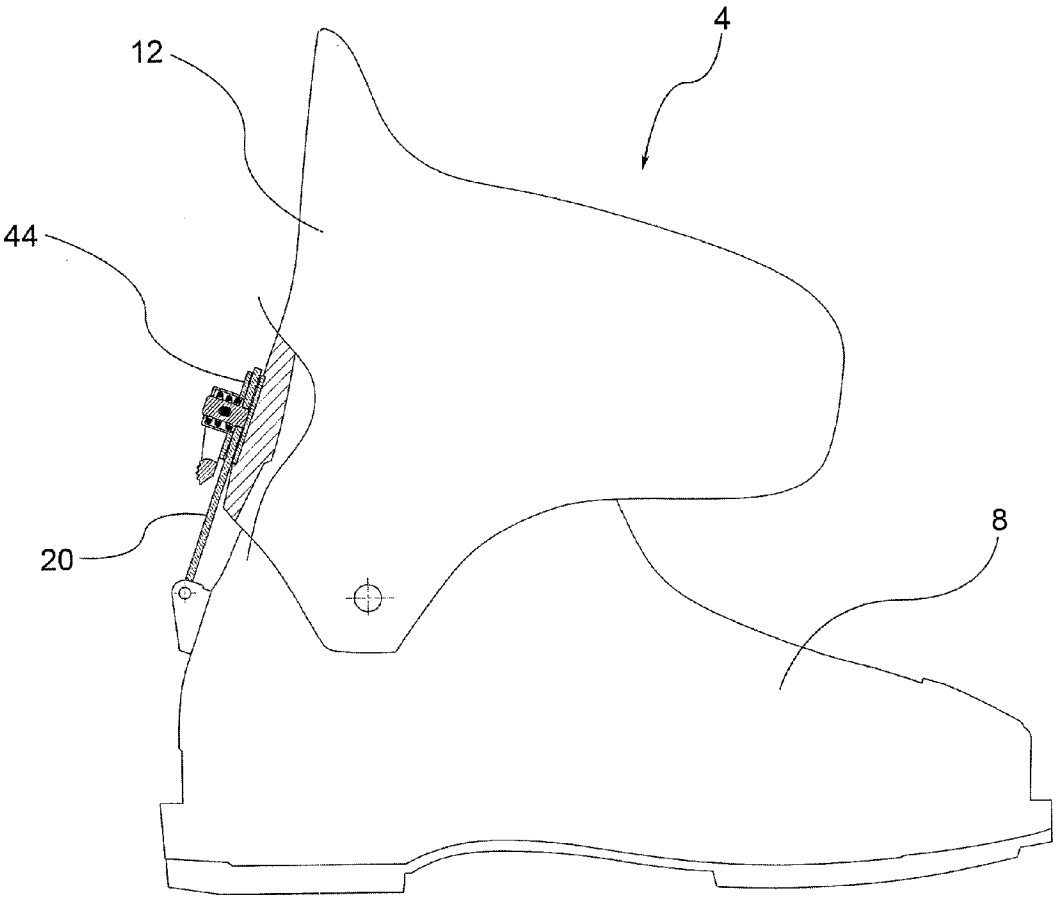
FIGS. 1-2 show lateral views, in partial cross-section, of an off-track ski boot according to the prior art, in a skiing configuration and walking configuration respectively.

The elements or parts of elements common to the embodiments described below will be indicated using the same reference numerals.

With reference to the aforementioned figures, reference numeral 4 globally denotes an off-track ski boot comprising a lower part or foot portion 8, suitable for enclosing the skier's foot and an upper part or leg portion 12, suitable for enclosing the lower part of the skier's leg.

The definitions of foot and leg portion should be considered in a general and non-restrictive manner: the present invention does not present any type of limitation with reference to the shape, dimensions, materials, type of foot or leg portion and therefore types of foot and leg portions which at least partially enclose the foot or upper part of the skier's leg, or shin, also fall within the invention.

In the off-track ski boot type, as in the case of the present invention, the leg portion 12 is hinged to the foot portion 8 by at least one hinge 14 so as to be able to rotate in relation to the foot portion around a rotation axis.

The type of hinge 14 may vary and preferably a pair of hinges positioned on opposite lateral sides of the leg portion 12 are envisaged.

Preferably, the hinges 14 identify horizontal rotation axes X-X, that is, parallel to the sole of the ski boot.

The ski boot 4 comprises means of constraint 16 suitable for selectively blocking and/or unblocking the rotation of the leg portion 12 to the foot portion 8 depending on whether the user wishes to pass from a skiing configuration to a walking configuration: selective blocking/unblocking is taken to mean that the user may operate the constraint means 16, as described further below, to pass at will from one configuration to the other.

Advantageously, the constraint means 16 comprise at least one rod 20 having a fixed end 24 hinged to the foot portion 8 and a mobile end 28 which interfaces with the leg portion 12.

The rod 20 is generally an elongated shape and may present any type of geometry and/or cross-section, and may also be made in any material.

The fixed end 24 may be hinged to the foot portion 8 in various ways; preferably the hinge axis Y-Y of said fixed end 24 is parallel to said rotation axis X-X.

The fixed end 24 is for example constrained to a protuberance 32 made specially at the heel of the foot portion 8.

The constraint means 16 comprise a support 40 attached to the leg portion 12 and at least one guide 44, connected to the support 40 and suitable for receiving and guiding the mobile end 28 of the rod 20.

The support 40 for example comprises a first toothing 48, on the side opposite the rod 20, and a cover plate 52 attached to the leg portion 12 and fitted with a second toothing 56 engaged with the first toothing 48 so as to constrain the leg portion 12 and the support 40 to each other, said toothings 48, 56 extending in the same longitudinal direction L-L.

Preferably, the support 40 and the cover plate 52 are joined to each other by removable connection means 60 such as screws, so as to be able to adjust at will the relative longitudinal position between the leg portion 12 and the support 40.

The toothings 48, 56 have the same pitch so as to be able to reciprocally mesh in any reciprocal position: they may be replaced by any other means of adjusting and blocking the relative longitudinal position between the support 40 and the cover plate 52.

Rails with continuous sliding and relative locking means may even be envisaged.

Advantageously, the guide 44 is mobile in relation to the support 40 and to the leg portion 12 so as to be able to move in relation to the leg portion 12 under the thrust of the rod 20, moving along with the rotation of the rod 20 around its fixed end 24 during the movement of the leg portion 12 in relation to the foot portion 8.

According to one embodiment, the guide 44 is hinged to the support 40 in relation to a pin 64 parallel to said rotation axis X-X of the foot portion 12: this way the guide 44 can rotate around its pin 64 under the thrust received from the mobile end 28 of the rod 20.

According to one embodiment, the guide 44 comprises a box-shaped body having an entrance slot 68 suitable for receiving with clearance the mobile end 28 of the rod so as to permit the insertion and relative sliding of the rod 20 in relation to the box-shaped body of the guide 44.

The entrance slot 68 is preferably counter-shaped to the mobile end 28: for example both the mobile end 28 and the entrance slot have a rectangular cross-section, with the longer base directed parallel to the hinge axis Y-Y.

Preferably, the guide 44 is hinged to the support 40, in relation to the pin 64, on the side opposite said entrance slot 68.

According to one embodiment, the guide 44 is influenced by a first spring 70 which acts elastically on the guide 44 so as to press it to move into a position away from the support 40, that is, offset in relation to the associable rod 20.

Said first spring 70 is preferably a leaf spring; for example the first spring 70 is constrained at the pin 64. The first spring 70 comprises at least one branch 71, preferably a pair of branches 71, which couple to respective lateral portions 72 of the guide 44. The first spring 70 may also be of the coil type or any other type.

The box-like body of the guide 44 comprises at least one aperture 74 which extends beyond the entrance slot 68, on the side opposite the support 40.

Figure 5:
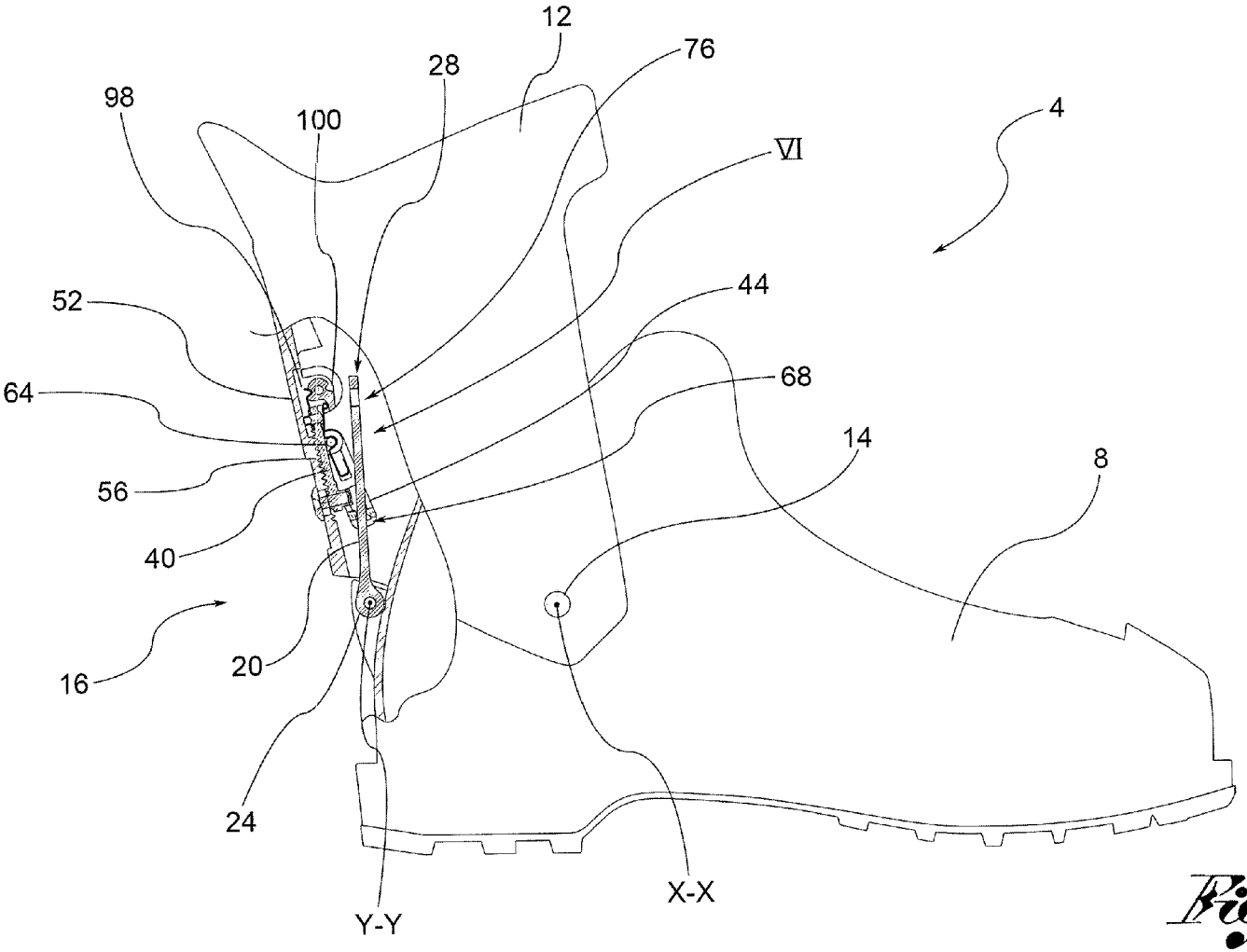
FIG. 5 shows a lateral view, in partial cross-section of an off-track ski boot according to the present invention in a skiing configuration.
Figure 6B:
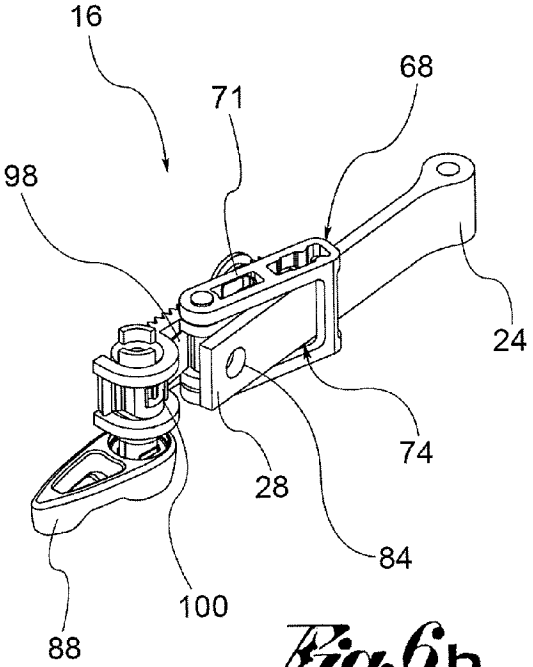
FIG. 6 shows views from different angles of the particular VI in FIG. 5.
Figure 6A:
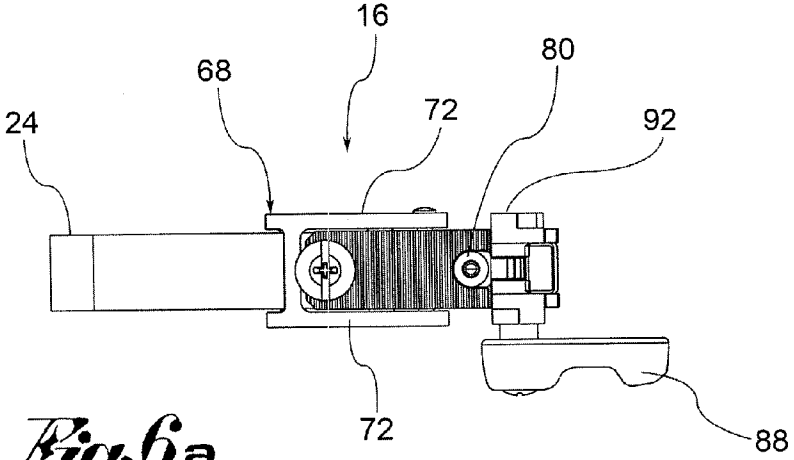
Figure 6C:
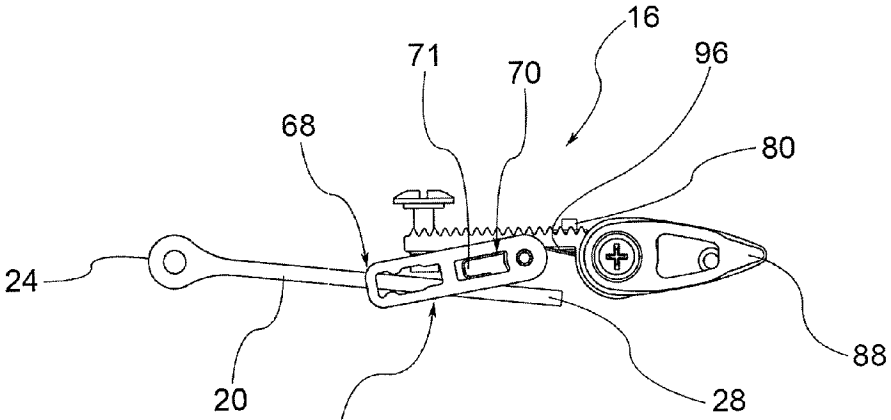

Said aperture 74 is of such breath as to permit the crossing by the mobile end 28 of the rod 20 so as to enable the rod 20 to position itself in a direction at an angle or incident with the guide 44 and even come out of the guide 44 without encountering any resistance from said guide (FIG. 5-6).

In other words, the guide 44 may be entirely traversed by the mobile end 28 of the rod 20 so as be pushed and moved by the rod 20, which rotates around its fixed end 24, without posing resistance to said rod.

Preferably, the constraint means 16 comprise a hollow seat 76 defined inside the leg portion 12 in such a way as to permit the housing of the mobile end 28 of the rod 20 coming out of said aperture 74, without such mobile end 28 encountering obstacles to its sliding.

The constraint means may be made from any material; for example the rod 20 and the guide 44 in metal can be made for example in light alloy, but also in low friction polymer material, so as to favour as much as possible the sliding of the rod 20 inside the guide 44. The constraint means 16 further comprise at least one peg or stop 80, connected to the support 40 and suitable for inserting itself inside a corresponding hole 84 made on the rod 20, the peg 80 being operable from a retracted position in which it does not intercept said hole 84, leaving the rod 20 free to rotate, and an extracted position in which it inserts itself inside said hole 84, preventing any relative movement between the rod 20 and the support 40 and thereby preventing the rotation of the leg portion 12 in relation to the foot portion 8.

The hole 84 of the rod 20 is positioned in an intermediate position between the fixed end 24 and the mobile end 28: preferably, the hole 84 is positioned at the mobile end 28 of the rod 20.

According to one embodiment, the peg 80 is operatively connected to an operating lever 88 fitted with at least one cam 92 for shifting the peg 80 from the extracted position to the retracted position and vice versa.

The operating lever 88 is accessible from the outside of the leg portion 12 so as to be easily operated by the skier.

Preferably, the operating lever 88 is elastically influenced by a second spring 96 having appendages 98; the cam 92 has at least two notches 100 suitable for receiving said appendages 98 upon reaching limit stop positions corresponding to the blocking and unblocking positions of the rod 20.

In other words, the cam 92 has notches 100 which delimit the limit stop positions for blocking and unblocking the rod 20; the appendages 98 of the second spring 96 engage in said notches 100 upon reaching said limit stop positions.

Preferably, the first and the second spring 70, 96 are made in one piece with each other in a single leaf spring. A single spring of a different type may also be used, such as a coil spring, which encompasses in one piece the first and second spring 70, 96.

The functioning of an off-track ski boot according to the invention will now be described.

Figure 3:
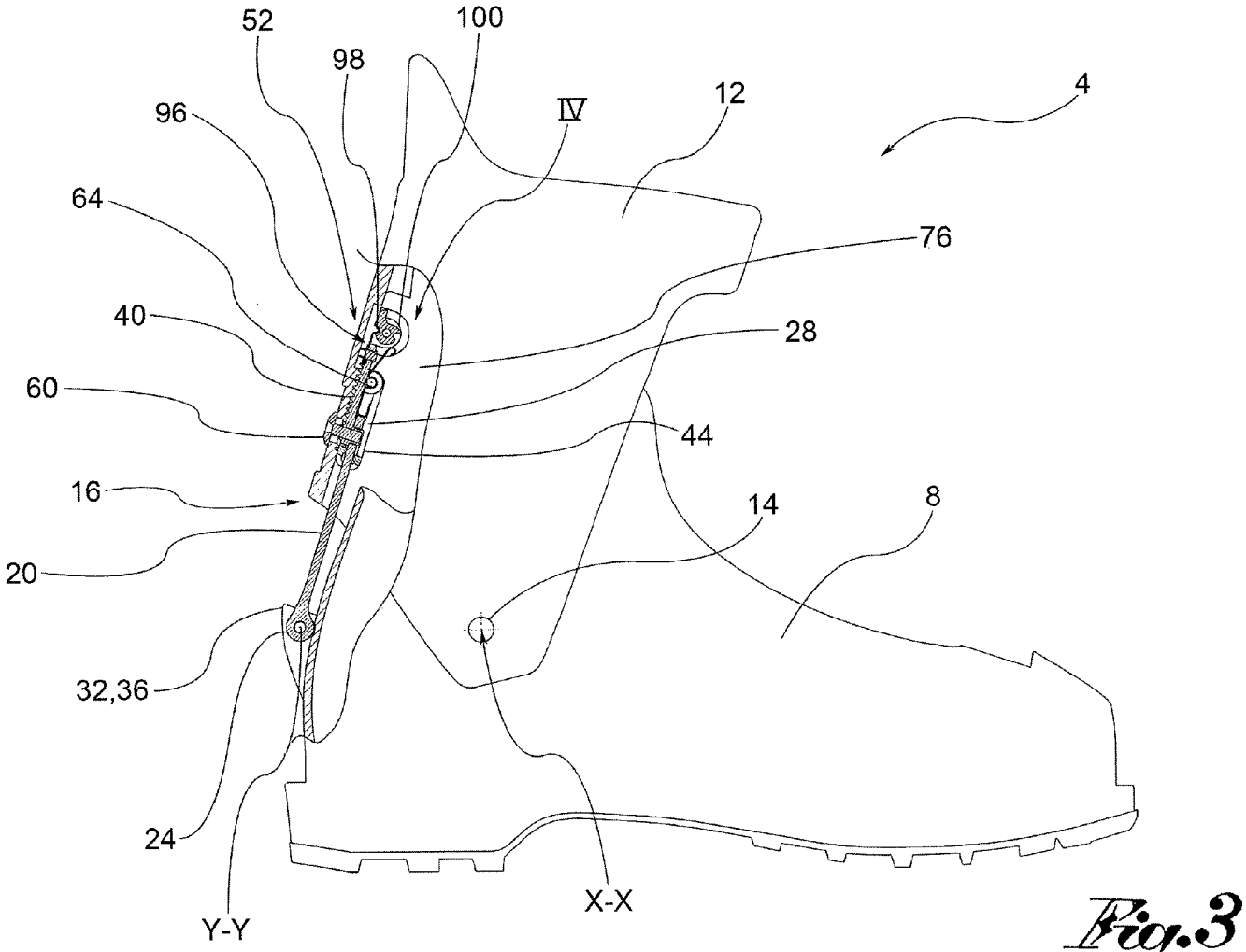
FIG. 3 shows a lateral view, in partial cross-section of an off-track ski boot according to the present invention in a skiing configuration.
Figure 4B:
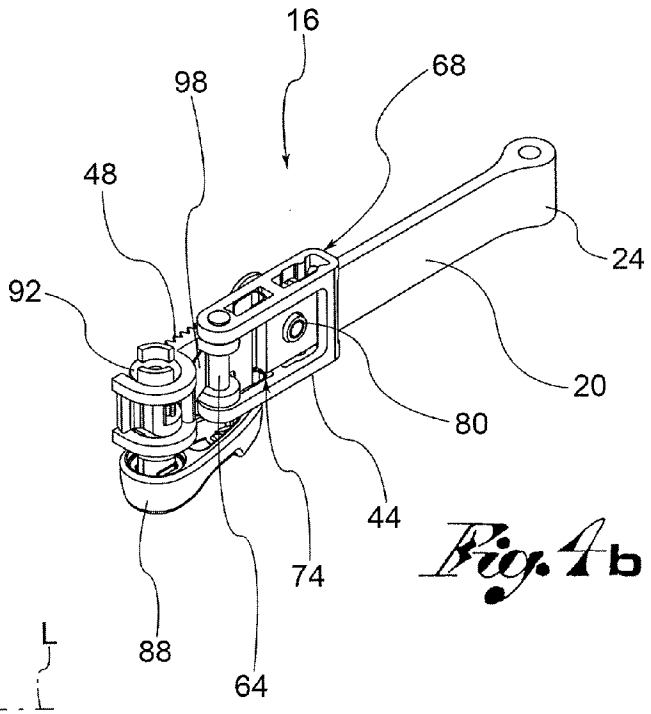
FIGS. 4*a*-4*c* show views from different angles of the particular IV in FIG. 3.
Figure 4A:
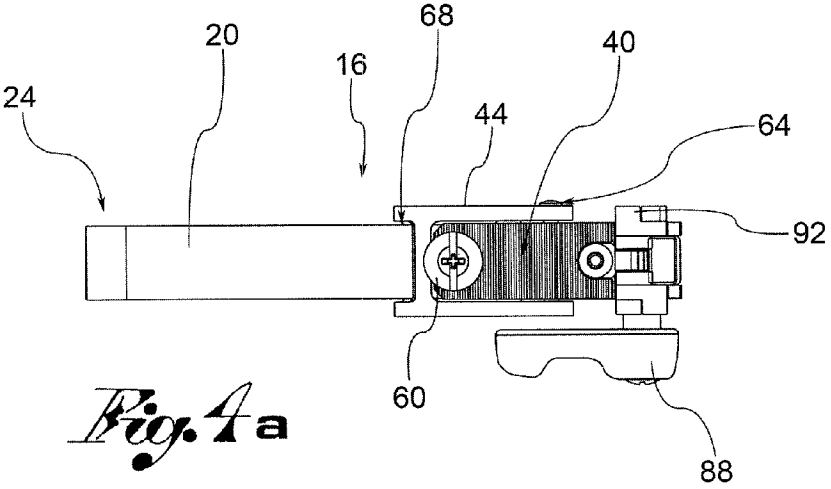
Figure 4C:
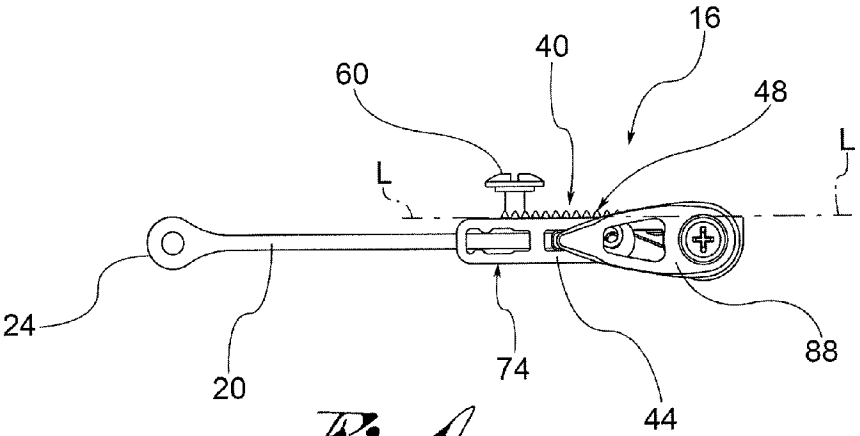

In particular, in the skiing configuration (FIG. 3) the peg 80 is engaged in the corresponding hole 84 of the guide 44 so as to join the guide 44 to the support 40 and the leg portion 12: this way the leg portion 12 can no longer rotate in relation to the foot portion 8. in such skiing configuration, the guide 44 is positioned substantially parallel to the rod 20 and the support 40, forming a firm constraint which prevents the movement of the leg portion 12.

As needed, the user may then operate the operating lever 88 so as to unblock/raise the peg 80 and disengage it from the relative hole 84.

In this walking configuration, the guide 44, hinged at one end only, is able to move along with the rotations/movements of the rod 20, which is free to rotate in relation to the fixed end 24 under the thrust of the leg portion 12.

In fact, when the user shifts his weight when walking, he pushes the leg portion 12 backwards and forwards, dragging with it in rotation the operating lever 88.

The latter is free to slide through the entrance slot 68 of the guide 44 and to drag with it in rotation said guide. The rod 20, moreover, can position itself in a position not parallel, that is, incident, to the guide 44, even coming out of said guide through the aperture 74 with its mobile end 28.

Moreover, the mobile end 28 may easily be housed in the seat 76 inside the leg portion 12 without encountering any obstacle.

This way the mobile end 28 does not encounter any resistance either from the guide 44 or from other elements of the foot portion 8: the only resistance encountered by the rod 20 is given by contact with the walls delimiting the entrance slot 68 of the guide 44. Such resistance is however minimal given that the guide 44 is not fixed but free to rotate around its pin 64 so that the friction between the guide 44 and the rod 20 is limited and entirely negligible.

Figure 2:
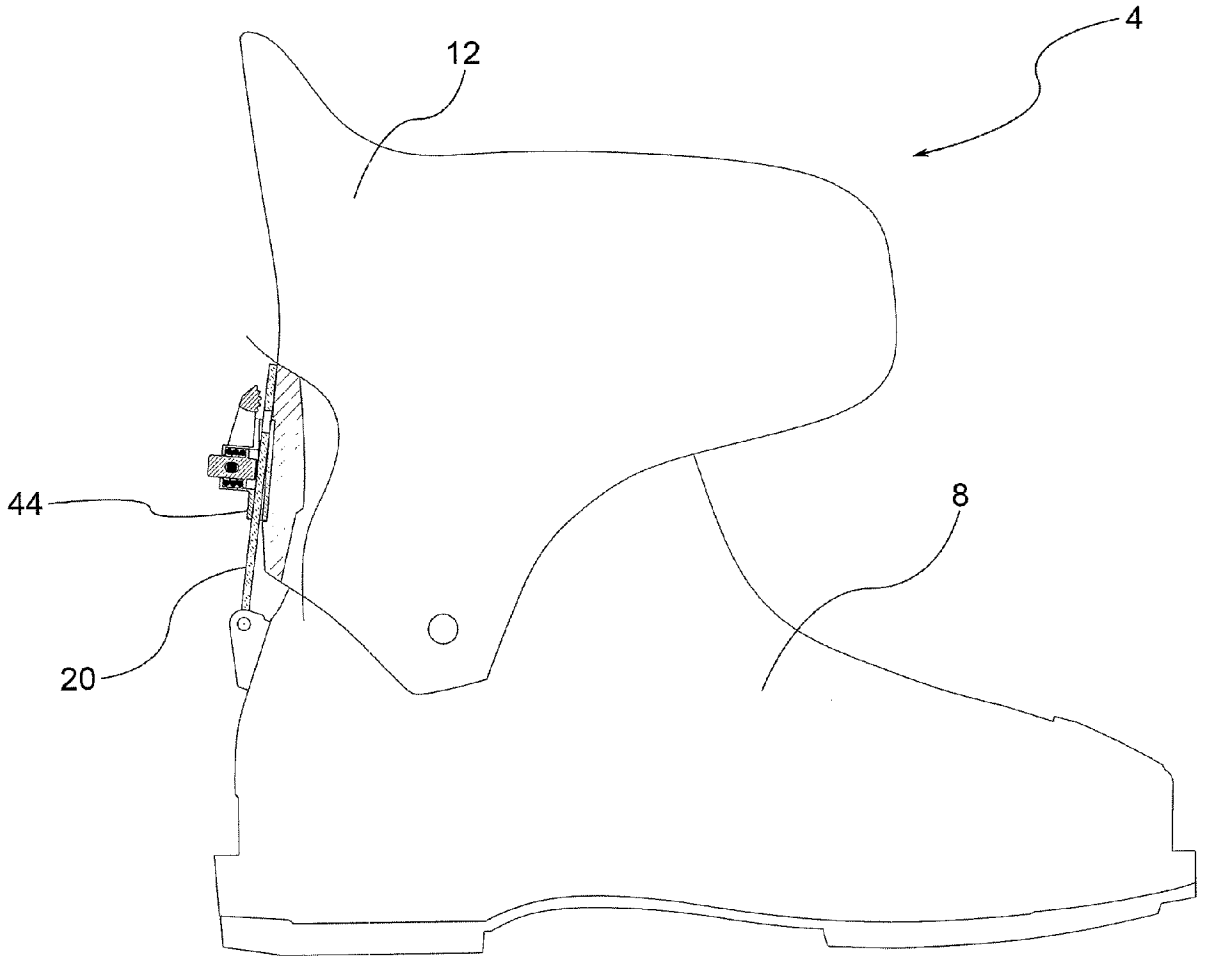

This functioning condition is entirely different from the solutions of the prior art wherein (FIG. 2) the guide is fixed so that it poses significant resistance to the inner sliding of the rod.

As may be appreciated from the description, the ski boot according to the invention makes it possible to overcome the drawbacks of the prior art presented.

In particular, the rotation of the leg portion does not encounter any noticeable resistance by the rod, given that the rod is free to slide inside the guide.

The blocking and unblocking mechanism is extremely reliable and easy to use: in fact the use of a mobile guide in relation to the support, not only facilitates the movement of the leg portion, but does not create any problem of ease of operation.

Moreover, the inner spring always recalls the guide away from the rod so as to reduce contact, and therefore friction, between the guide and the rod, as much as possible, aside from the contact with the entrance slots of the guide.

Moreover, there are no constraints to the positioning of the hinges of the leg portion to the foot portion: the designer thereby has greater freedom.

A person skilled in the art may make numerous modifications and variations to the ski boots described above so as to satisfy contingent and specific requirements, all contained within the sphere of the invention as defined by the appended claims.

The invention claimed is:

1. A ski boot comprising a lower part or foot portion, suitable for enclosing the skier's foot and an upper part or leg portion, suitable for enclosing the lower part of the skier's leg, wherein the leg portion is hinged to the foot portion so as to be able to rotate in relation to the foot portion around a rotation axis, wherein the ski boot comprises means of constraint suitable for selectively blocking and/or unblocking the rotation of the leg portion to the foot portion depending on whether the user wishes to pass from a skiing configuration to a walking configuration, wherein the constraint means comprise at least one rod having a fixed end hinged only to the foot portion and a mobile end which interfaces with the leg portion, wherein the constraint means comprise a support attached to the leg portion and at least one guide, connected to the support and suitable for receiving and guiding the mobile end of the rod, wherein the guide is mobile in relation to the support and to the leg portion so as to be able to move in relation to the leg portion under the thrust of the rod, moving along with the rotation of the rod around its fixed end during the movement of the leg portion in relation to the foot portion;

wherein the guide comprises a box-shaped body having an entrance slot delimited by walls on all sides, the entrance slot being suitable for receiving with play the mobile end of the rod so as to permit the insertion and longitudinal sliding of the rod in relation to the box-shaped body of the guide;

wherein the guide is hinged to the support on the side opposite the entrance slot; and wherein the box-shaped body comprises an aperture which extends beyond the entrance slot, on the side opposite the support, so as to enable the rod to position itself in a direction angled or incident to the guide and to permit the mobile end of the rod to come out of the guide.

2. Ski boot according to claim 1, wherein the guide is hinged to the support in relation to a pin parallel to said rotation axis of the foot portion.

3. Ski boot according to claim 1, wherein the constraint means comprise a hollow seat defined inside the leg portion in such a way as to permit the housing of the mobile end of the rod coming out of said aperture, without such mobile end encountering obstacles to its sliding.

4. Ski boot according to claim 1, wherein the guide is influenced by a first spring which acts elastically on the guide so as to press it to move into a position away from the support, that is, offset in relation to the associable rod.

5. Ski boot according to claim 4, wherein said first spring is constrained at a pin which the support is hinged to and comprises at least one branch which couples to a respective lateral portion of the guide.

6. Ski boot according to claim 1, wherein the constraint means comprise at least one peg, connected to the support and suitable for inserting itself inside a corresponding hole made on the rod, the peg being operable from a retracted position in which it does not intercept said hole, leaving the rod free to rotate to an extracted position in which it inserts itself inside said hole, preventing any relative movement between the rod and the support and thereby preventing the rotation of the leg portion in relation to the foot portion.

7. Ski boot according to claim 6, wherein the peg is operatively connected to an operating lever fitted with at least one cam for shifting the peg from the extracted position to the retracted position and vice versa.

8. Ski boot according to claim 7, wherein the operating lever is elastically influenced by a second spring having appendages.

9. Ski boot according to claim 8, wherein the cam has at least two notches suitable for receiving said appendages upon reaching limit stop positions corresponding to the blocking and unblocking positions of the rod.

10. Ski boot according to claim 4, wherein the first spring and a second spring are made in one piece with each other in a single spring.

11. Ski boot according to claim 1, wherein the support comprises a first toothing, and a cover plate attached to the leg portion and fitted with a second toothing engaged with the first toothing so as to constrain the leg portion and the support to each other, said toothings extending in the same longitudinal direction.

12. Ski boot according to claim 11, wherein the support and the cover plate are joined to each other by removable connection means, so as to be able to adjust the relative longitudinal position of the leg portion and the support.

* * * * *